US007369934B2

(12) United States Patent
Chatfield et al.

(10) Patent No.: US 7,369,934 B2
(45) Date of Patent: May 6, 2008

(54) PREDICTIVE ENGINE COMBUSTION MANAGEMENT

(75) Inventors: Glen F. Chatfield, Bradfordwoods, PA (US); Dale K. Wells, Eighty Four, PA (US)

(73) Assignee: OPTIMUM Power Technology, L.P., Bridgeville, PA (US)

( * ) Notice: Subject to any disclaimer, the term of this patent is extended or adjusted under 35 U.S.C. 154(b) by 0 days.

(21) Appl. No.: 11/214,231

(22) Filed: Aug. 29, 2005

(65) Prior Publication Data

US 2006/0047406 A1 Mar. 2, 2006

(51) Int. Cl.
*G06F 17/00* (2006.01)
*F02M 51/00* (2006.01)

(52) U.S. Cl. ..... 701/104; 123/480

(58) Field of Classification Search ..... 701/103, 701/104, 110; 123/406.5, 406.51, 492, 493; 700/44

See application file for complete search history.

(56) References Cited

U.S. PATENT DOCUMENTS 4,424,568 A 1/1984 Nishimura et al.
4,548,185 A 10/1985 Pozniak
4,630,206 A * 12/1986 Amamo et al. ..... 701/110
5,069,184 A * 12/1991 Kato et al. ..... 123/406.51
5,297,048 A 3/1994 Gauer
6,026,781 A 2/2000 Imatake et al.
6,170,475 B1 * 1/2001 Lewis et al. ..... 123/568.21
6,363,316 B1 3/2002 Soliman et al.
2002/0078924 A1 6/2002 Yagi
2004/0084020 A1 * 5/2004 Daniels et al. ..... 123/406.23
2004/0144369 A1 7/2004 Song et al.

FOREIGN PATENT DOCUMENTS

EP 0 365 003 A2 4/1990

* cited by examiner

*Primary Examiner*—Carl S. Miller
*Assistant Examiner*—Arnold Castro
(74) *Attorney, Agent, or Firm*—Richard W James

(57) ABSTRACT

A system, apparatus, and method for predicting an engine operating condition and providing a component in accordance with the prediction.

25 Claims, 6 Drawing Sheets

Engine Control System

PREDICTIVE ENGINE COMBUSTION MANAGEMENT

CROSS-REFERENCE TO RELATED APPLICATIONS

None.

FIELD OF THE INVENTION

The present invention is directed to an engine combustion management system for an internal combustion engine. In particular, this invention is directed to a system and method that predicts a future engine operating state and alters an operating parameter accordingly.

BACKGROUND OF THE INVENTION

It is generally accepted that the performance of an internal combustion engine is dependent on a number of factors that may include the operating cycle (e.g., two-stroke having 360 degrees of crankshaft rotation per cycle, four-stroke having 720 degrees of crankshaft rotation per cycle or Wankel rotary engines), the fuel type (e.g., gasoline, diesel, alcohol, liquid petroleum gas (LPG), or natural gas), the number and design of combustion chambers, the selection and control of ignition and fuel delivery systems, and the ambient conditions in which the engine operates.

Examples of design choices for a combustion chamber include choosing a compression ratio and choosing the numbers of intake and exhaust valves associated with each chamber.

With regard to ignition systems, breaker point systems and electronic ignition systems are known ignition systems. Those systems provide spark timing based on one or more operating characteristics of the engine, e.g., speed of rotation and load. In the case of breaker point systems, engine speed is frequently detected mechanically using centrifugally displaced weights and intake manifold pressure or exhaust manifold pressure is commonly used to detect engine load. In the case of electronic ignition systems, engine speed is often detected with an angular motion sensor associated with rotation of the crankshaft and engine load is frequently detected by a throttle position sensor, an intake manifold pressure sensor or a mass airflow sensor. In each case, spark timing may be fixed for a given steady operating state of the engine.

With regard to fuel delivery systems, carburetors and fuel injection systems are known. Those known systems supply a quantity of fuel, e.g., gasoline or diesel fuel and air, in accordance with the position of the throttle as set by the operator. In the case of carburetors, fuel is typically delivered by a system of orifices, known as "jets." As examples of carburetor operation, an idle jet may supply fuel downstream of a throttle valve at engine idling speeds, and that fuel delivery may be boosted by an accelerator pump to facilitate rapid increases in engine load.

Known fuel injection systems, which can be operated electronically, generally spray a metered amount of fuel into the intake system or directly into the combustion cylinder. The fuel quantity is often determined by a controller based on the state of the engine and a data table known as a "map" or "look-up table." The map typically includes a collection of possible values or "setpoints" for each of at least one independent variable that may be a characteristic of the state of the engine, which can be measured by a sensor connected to the controller, and a collection of corresponding control values for a dependent variable control function, such as fuel quantity.

Conventionally, factory calibrated maps are typically developed by the engine manufacturer and permanently set in an engine control unit at the factory. The manufacturers may further prevent engine operators from modifying the maps for a variety of reasons, such as the manufacturers believe that their maps provide the best engine performance, the manufacturers are concerned that an engine operator might damage the engine by specifying inappropriate control values, or the manufacturers assume that an engine operator might not have sufficient skill to properly modify a map. However, it is believed that the manufacturers have "optimized" their maps to perform best under a set of conditions that they specify. In certain cases, however, it is believed that those conditions do not match the conditions in which the engine is operated. Consequently, stock maps sometimes limit, rather than optimize, an engine's performance.

Conventional maps, furthermore, are typically created to provide fuel delivery and ignition timing suitable for the engine when operating at a steady-state. Thus, map values may not be appropriate for an engine operating in transition such as, for example, an accelerating or decelerating engine.

Further, engine performance is believed to be substantially dependent on how combustion is accomplished in the ambient conditions. The stoichiometric mass fraction ratio of air to gasoline is approximately 14.7:1. However, it is believed that ratios from about 10:1 to about 20:1 will combust, and that it is often desirable to adjust the air-fuel ratio ("AFR") to achieve specific engine performance, such as a desired level of power output, better fuel economy, or reduced emissions. Properly calibrating the fuel delivery system of an engine to deliver the optimum AFR under all operating conditions is an important goal of many calibration efforts. It is also frequently a time consuming, difficult, and costly part of the calibration effort. Similarly, it may also be desirable to adjust ignition timing, commonly measured in degrees of crank rotation before a piston reaches top-dead-center of the compression stroke, to achieve specific engine performance, such as low fuel consumption or reduced emissions.

In the current state of the fueling art, injected engine fueling is typically based on one or an average of several engine speed and load readings taken during one or more previous engine cycles. As will be recognized, when an engine is transitioning to a higher or lower speed or load or otherwise changing operating conditions during a current combustion cycle, the operational information from those previous engine cycles is likely not to be appropriate for a current engine cycle. Thus there may be a need for systems, apparatuses, and methods for considering transitions in engine operating conditions when controlling engine combustion. There may also be a need for systems, apparatuses, and methods for predicting future engine operating conditions when controlling engine combustion and utilizing that information to provide fueling, quantity, ignition timing, exhaust gas recirculation or other components of combustion.

SUMMARY OF THE INVENTION

Embodiments of predictive engine combustion management are directed to systems, methods and apparatuses for predicting one or more combustion related characteristics or factors such as a state of the engine or a desired engine operation, or transitions such as transitions in engine operating conditions such as engine operating level or load, and using those predictions to control engine combustion.

In accordance with one embodiment of predictive engine combustion management, a method of predicting a quantity of a physical component of a combustion event includes receiving at least two values related to a characteristic to be considered in a combustion event, predicting a future value of the characteristic, and determining a quantity of a physical component of the combustion event based on the predicted future value of the characteristic.

In accordance with another embodiment of predictive engine combustion management, a predictive combustion device is provided that includes a data acquisition unit having an input at which is to be incident a signal received from a first sensor related to a characteristic to be considered in a combustion event, an output at which is to be incident a signal related to a physical component of the combustion event, and a processor. The processor may contain instructions which, when executed by the processor, cause the processor to predict a future state of the characteristic to be considered in the combustion event and provide the signal at the output related to the physical component of the combustion event based on the predicted state of the characteristic.

In an embodiment of predictive engine combustion management, a state of a characteristic or value related to a characteristic to be used in determining a physical component of a combustion event is predicted or estimated and the physical component is provided in accordance with the predicted state or value. The characteristic may be, for example, one or more operating states of the engine or one or more desired operating states of the engine or both. The operating state of the engine may be, for example, the rotational speed of the engine or the load. The physical component may be a quantity of fuel, ignition timing a quantity of exhaust gas to be recirculated, or another component that is appropriate for the operating state that is predicted to exist at a desired time. The physical component may then be provided to the engine as appropriate for the predicted state or value of the characteristic.

In an embodiment, a method calculates the rate of change of the engine state or characteristic or a higher derivative of the engine state or characteristic, uses the calculated rate of change or higher derivative to project the engine state or characteristic at an appropriate time in the future and provides the physical component in accordance with the projected engine state or characteristic.

Those embodiments and the other embodiments discussed herein may furthermore be implemented in an engine, a cylinder, an engine control unit or engine control system controlling such an engine or cylinder, or a computer readable medium that may be executed by a processor to control such an engine or cylinder.

Accordingly, the present invention provides solutions to the shortcomings of prior engine control systems, apparatuses, and methods. Those of ordinary skill in the art will readily appreciate, therefore, that those and other details, features, and advantages of the present invention will become further apparent in the following detailed description of the preferred embodiments of the invention.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of embodiments of predictive engine combustion management in accordance with a best mode contemplated for carrying out predictive engine combustion management.

DETAILED DESCRIPTION OF THE INVENTION

Figure 1:
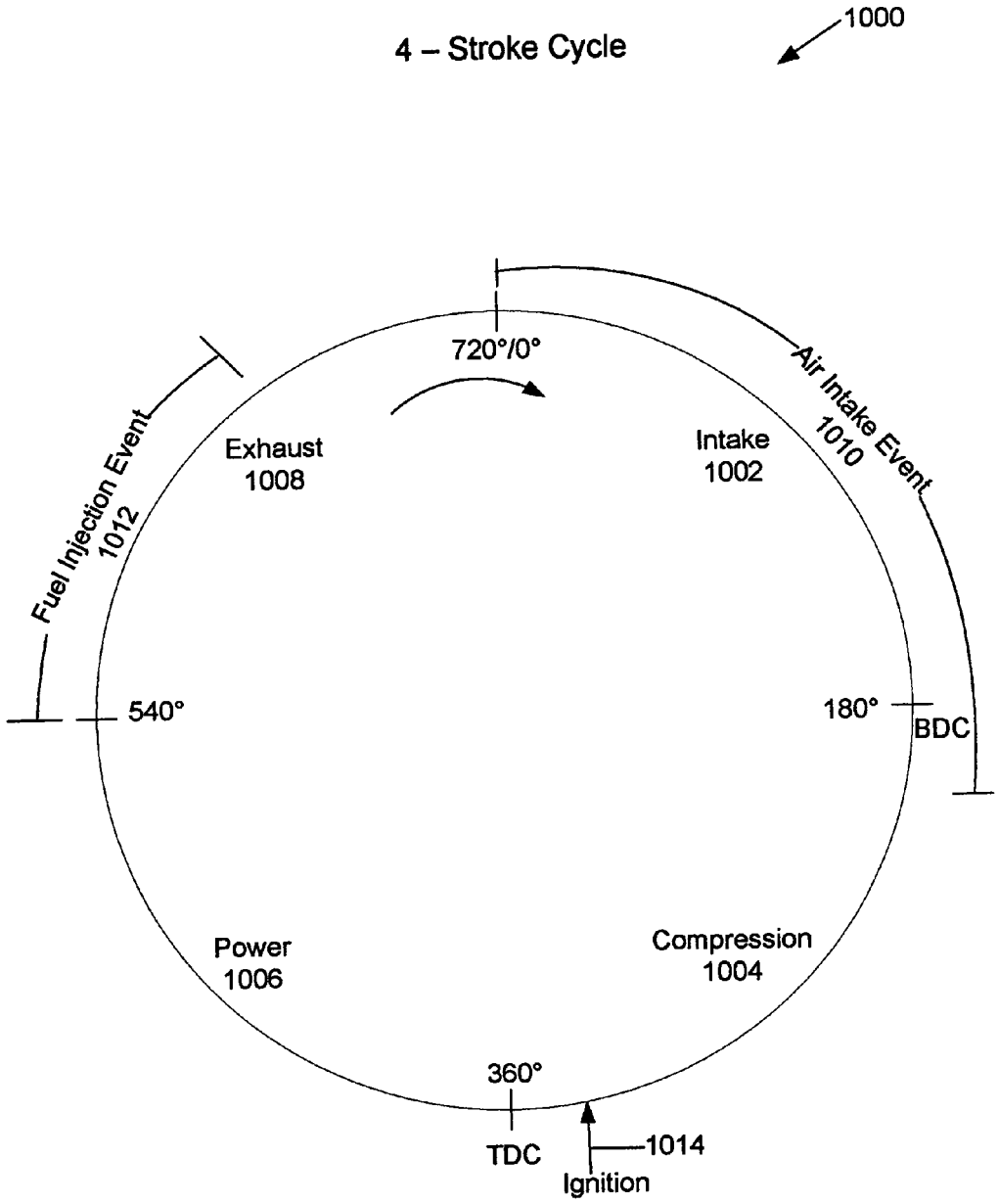
FIG. 1 illustrates an embodiment of a 4-stroke cycle.

Reference will now be made to embodiments of predictive engine combustion management, examples of which are illustrated in the accompanying drawings. Details, features, and advantages of predictive engine combustion management will become further apparent in the following detailed description of embodiments thereof. It is to be understood that the Figures and descriptions included herein illustrate and describe elements that are of particular relevance to predictive engine combustion management, while eliminating, for purposes of clarity, other elements found in typical engines and engine control systems.

Systems, apparatuses, and methods to perform predictive engine combustion management are described herein. Aspects of those embodiments may also be included in processor based apparatuses, multi-processor based systems, and articles of manufacture that contain instructions which, when executed by a processor cause the processor to predictively manage engine combustion. Any reference in the specification to "one embodiment," "a certain embodiment," or any other reference to an embodiment is intended to indicate that a particular feature, structure or characteristic described in connection with the embodiment is included in at least one embodiment and may be utilized in other embodiments as well. Moreover, the appearances of such terms in various places in the specification are not necessarily all referring to the same embodiment. References to "or" are furthermore intended as inclusive so "or" may indicate one or another of the ored terms or more than one ored term.

In internal combustion engines, it is generally desirable to mix air and fuel uniformly in a ratio, or the stoichiometric mass fraction ratio of air to gasoline. Fuel injectors may, however, deliver fuel at a fixed rate while air intake may vary. Thus, fuel delivery may begin before airflow delivery begins or fuel delivery may cease prior to the cessation of airflow delivery in an attempt to match a fairly constant flow fuel injector to a variable flow air intake. Engines that do not deliver fuel and air delivery uniformly over time may suffer from a problem where fuel and air quantities are sometimes mismatched, particularly when changes in engine load occur, which are referred to herein as engine transitions. The effect of such a mismatch tends to be exacerbated at low engine speed because the amount that the throttle can be moved in a single engine cycle at low speed is greater than at high speed. Also, the effect of an air/fuel ratio mismatch tends to be exacerbated in an engine having one or few cylinders as opposed to an engine having many cylinders where, for example, the effect of a continuous throttle change occurring over one full cycle might have a full magnitude effect on a single cylinder engine but would effect each cylinder in an eight cylinder engine by only one-eighth of its magnitude. Most fuel injected engines, and particularly port fuel injection engines are examples of engines that do not provide fuel and air uniformly and in which it is likely that fuel/air ratio mismatches will occur.

For example, in a motorcycle, a rider may, in a single engine cycle, move the throttle from a low speed position such as idle corresponding to a 6% throttle position to an intermediate position or to a full load position corresponding to 100% throttle, such that a larger combustion event is appropriate. That engine may furthermore include only one or a few cylinders, such that the entire affect of that change in operating condition is placed on one or a few cylinders in one engine cycle.

In another example, a vehicle such as a car may include an engine having eight or more cylinders and the engine speed may increase one thousand or more rpm in a single engine cycle such that the speed of the engine varies significantly for one cylinder due to events occurring in other cylinders. Accordingly, it should be recognized that changes that affect combustion may be occurring at the same time that a cylinder is being prepared for its next combustion event. Embodiments of engine combustion management, therefore, provide methods, apparatuses, and systems for matching combustion components such as fuel, oxidant or air, recirculated exhaust gas, and ignition during engine transitions.

In an engine or cylinder cycle it may be recognized from the word "cycle" that a repetitive process is occurring. During that cycle certain events typically occur and those events typically occur at regular times or within regular time frames during each cycle. Thus, for example, a quantity of fuel may be desired to have been delivered to a combustion chamber by the time a combustion event is to occur. The time when that combustion event is to occur may be referred to as an "ignition time". Since fuel takes time to be delivered to the combustion chamber 212, a fuel quantity to be delivered is typically determined prior to the ignition time and prior to or at a time when fuel is to commence being delivered and that time that may be referred to as an "injection time."

The time at which fuel will be delivered and the quantity of fuel that is to be delivered may be determined prior to the injection time at a "schedule time." The quantity of fuel to be delivered may, furthermore, be a product of the duration of time that the fuel injector is energized and the injector on and off times may be determined from a map, table, or equation.

Next, it should be recognized that engine operating conditions or desired engine operation conditions may remain unchanged or nearly so during a combustion cycle, but they may also change during a combustion cycle. Thus, each of the engine operating characteristics or conditions utilized in determining fuel quantity to be delivered to an engine 30 or a cylinder 200 may have an associated value and an associated rate of change, as well as other derivatives of the value over time, and the value and its derivatives may exist at the injection time and may vary throughout the engine or cylinder cycle. Thus, fuel quantity to be delivered may be based on those values and derivatives as they exist at a time near when the fuel delivery cycle begins and, in embodiments of predictive fueling, fuel quantity to be delivered may be based on those values and derivatives as they exist during the fuel delivery cycle.

Thus, a fuel injection event is affected by duration and latency. Fuel injection duration indicates a quantity of fuel will take a period of time to move through a fuel injector, valve or other device. An example of fuel injection event duration may be envisioned by reference to FIG. 3, where a period of time is required for fuel to pass through a fuel injector 162. Fuel injection latency indicates that even after the fuel has passed through the fuel injector, it generally takes an additional period of time for the fuel to flow though a port to a cylinder, for example in a port fuel injected system, and even to disperse within a cylinder, for example in a direct fuel injection system. An example of fuel injection event latency may also be envisioned by reference to FIG. 3, where another period of time is required for fuel that has passed through the fuel injector 162 to travel through an inlet tract 202 and disperse in a cylinder 212.

Often due to the effect of latency, fuel injection is initiated prior to the introduction of an oxidant such as air into the inlet tract 202 and cylinder 212 so that fuel will be present to mix with the air as it passes through the inlet tract 202 and into the cylinder 212. Thus, for example in the port injection arrangement illustrated in FIG. 3, at least some fuel may be provided into the inlet tract 202 prior to permitting the oxidant to flow into the inlet tract 202 and the fuel present in the inlet tract 202 is mixed with the oxidant as the oxidant is drawn through the inlet tract 202 into the cylinder 212. In engines utilizing an inlet tract 202, fuel may be provided both when the inlet valve 204 is closed and when the inlet valve 204 is open.

Accordingly, certain fueling systems utilize current or filtered values read prior to the beginning of the fuel delivery cycle such that the information on which the fueling is based may be old and inappropriate by the time the air intake event takes place. Having accurate information regarding the quantity of fuel that will be appropriate at the time of the combustion event at the time that fueling begins may, therefore, be beneficial and an ability to modify fueling during the fuel delivery cycle based on updated engine operation information may also be beneficial in providing proper fueling in certain circumstances.

Figure 3:
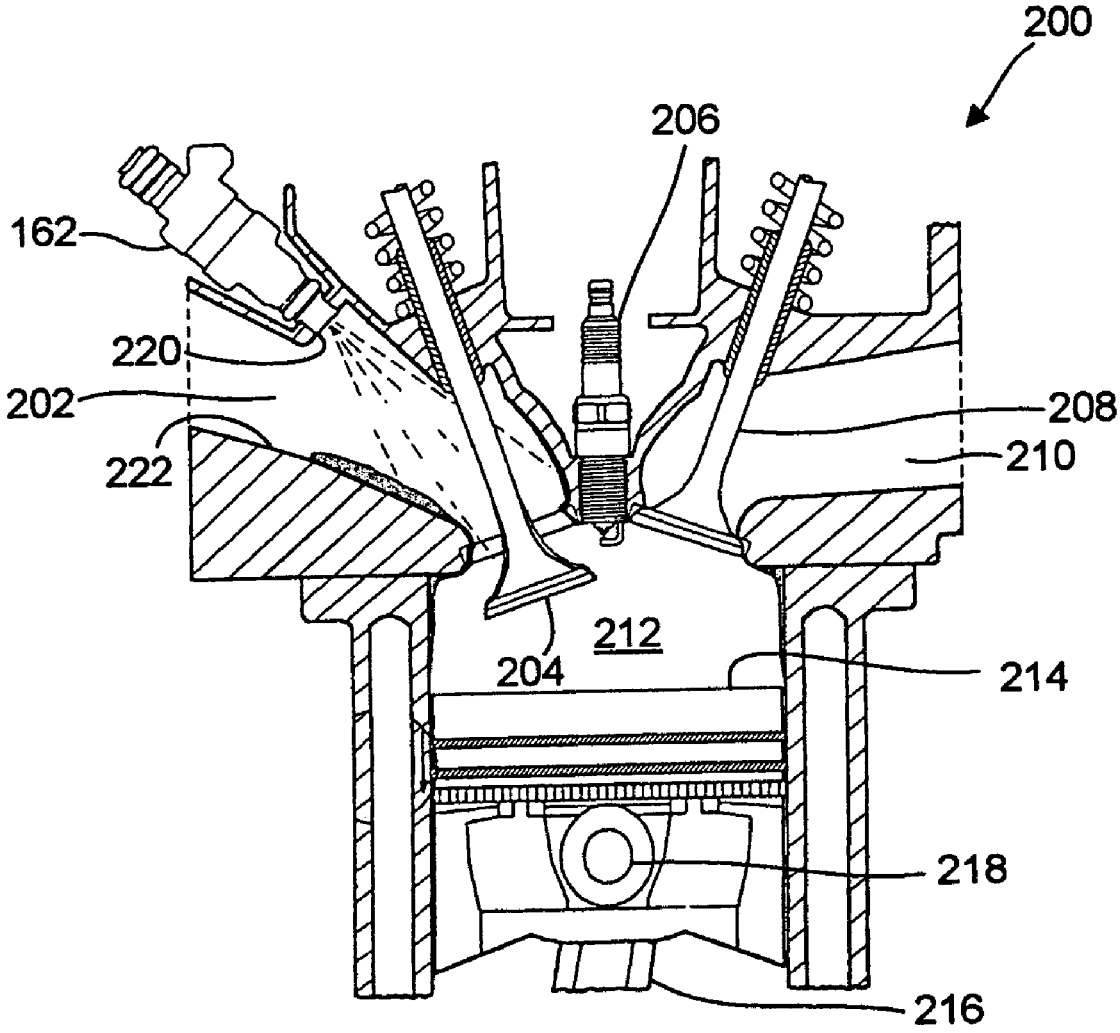
FIG. 3 illustrates an embodiment of a cylinder of a four-stroke engine that may be utilized in connection with predictive engine combustion management.

FIG. 1 illustrates an example of a cycle 1000 of a cylinder in a 4-stroke engine, such as the cylinder illustrated in FIG. 3. The 4-stroke cycle includes four movements or strokes of a piston 214 in the cylinder 212. One stroke of the piston 214 is an intake stroke during which the piston 214 moves away from the valves 204 and 208, drawing fuel and air into the cylinder 212 through the open intake valve 204, which is indicated at 1002 in FIG. 1. A second stroke of the piston is a compression stroke during which the piston 214 moves toward the valves 204 and 208, thereby compressing the air and fuel in the cylinder 212, which is indicated at 1004 in FIG. 1. A third stroke of the piston 214 is a power stroke during which the compressed fuel an air is burned and expanded, moving the piston 214 away from the valves 204 and 208, which is indicated at 1006 in FIG. 1. A fourth stroke of the piston is an exhaust stroke during which the piston 214 moves toward the valves 204 and 208, thereby causing the exhaust to move through the open exhaust valve 208 and through the exhaust tract 210, which is indicated at 1008 in FIG. 1.

An oxidant or air intake event 1010, illustrated in FIG. 1, occurs primarily during the intake stroke 1004 but may overlap into other portions of the 4-stroke cycle. The air may be drawn into the cylinder 212 through the open intake valve 204 by the low pressure condition caused by the piston 214 moving away from the valves 204 and 208. It may be desirable for the fuel to vaporize into the air before or while the air is flowing into the cylinder 212. To aid vaporization of the fuel into the air, the fuel is often supplied through the fuel injector 162, in whole or in part, prior to the time when the air begins to pass into the cylinder 212.

Fuel delivery may begin in the compression stroke and may overlap air delivery, but generally begins before air delivery. Accordingly, as illustrated in FIG. 1, a fuel injection event 1012 may begin prior to the initiation of the air intake event 1010.

Engine operation may be envisioned having two modes of operation, a steady-state mode and an unsteady-state mode, which will be referred to herein as a transitory or transient mode. An engine 30 may operate in a steady-state mode when the engine load and speed are constant with respect to time and in a transitory mode when either or both of the engine load and speed varies with time. Thus, an engine 30 may be operating in a transitory mode anytime engine operation shifts from one state to another. A transition may, therefore, correspond to a shift from any one position on a map to any other position on a map, such as the map illustrated in Table 1.

Maps are typically optimized for steady-state engine operation. Engines 30, however, are most often operated at varying speeds and loads. For example, the engine of a racing motorcycle may be continually changing its operating state because of changing track conditions, such as hills and turns, encountered on a typical racing track. Moreover, values such as the mass of fuel supplied to an engine, optimized for steady-state operation, are typically not optimum values for transitory operation.

When an engine is operating at a steady-state, the fueling requirements are often thought to be the same for each consecutive cylinder cycle. Engines may furthermore be operated at various steady-states in a laboratory and optimum fuel delivery may be determined by stepping the engine along its operating range. Thus, the fuel mass to be delivered for any steady-state operation may be easily determined and included in a map. Engines, however, typically transition from one operating state to another during use and the mapped steady-state fuel quantity is typically not optimized for such transitional operation. Moreover, an engine may transition in a nearly infinite number of ways. For example, during a transition, engine speed and load may change separately or together in a wide variety of combinations. Thus, mapping transitional calibration values may be very time consuming and difficult. In contrast, embodiments or predictive engine combustion management provide a general purpose method and apparatus to predict transitions and compensate for transitions by changing fuel delivery or other physical components of a combustion event based on the amount of change in engine operational state as may be reflected in a steady-state fuel calibration map or table for the engine.

In a fuel injection system in which a quantity or mass of fuel to be provided to one or more cylinders 212 is selected from a map, table, or equation based on engine operating conditions, those conditions may change during an engine cycle, thereby causing the engine operating condition at a time when the quantity of fuel to be delivered is determined to be different from the engine operating condition at a time when the quantity of air to be delivered is determined, resulting in an undesirable mismatch of the fuel/air ratio. Embodiments of predictive combustion management further provide methods, apparatuses, and systems to more closely match fuel and air quantities provided to an engine.

It may be seen by reference to FIG. 1 that airflow 1010 into the inlet tract 202 or the cylinder 212 may be determined by the load, engine speed, or another engine characteristic during the intake stroke 1002, while fuel flow 1012 into the inlet tract 202 or the cylinder 212 may be determined by the load or another engine characteristic during the power stroke 1006. Therefore, to achieve a proper air/fuel ratio, an embodiment of predictive combustion management predicts the airflow that will be provided for the next combustion event in the next power stroke 1006 and provides fuel for to match the predicted airflow for that next combustion event, rather than providing a fuel quantity determined during the previous power stroke or another time prior to initiation of fuel injection. That embodiment provides fuel appropriate for the next power stroke 1006 by measuring a current engine characteristic, such as load which may be indicated by throttle position, and the rate of change or another derivative of that characteristic, and predicts the value of that characteristic at a later time, such as during the intake stroke. That embodiment may also provide fuel for the next power stroke 1006 based on a second characteristic, such as engine speed and engine acceleration and predict the value of that characteristic at a later time, such as during the intake stroke. That embodiment may then use the predicted value or values when calculating a desired fuel quantity or selecting a fuel quantity from a fuel map or table. Then the predicted fuel value, with or without transient compensation, may be delivered rather than the fuel value associated with the current or past characteristic value or values.

Embodiments of predictive combustion management may be beneficial in many operating conditions including transitions from steady-state operation, transitions to steady-state operation, and transition occurring amongst other transitions. When an engine is started, a transition occurs that may also benefit from embodiments of predictive combustion management.

Benefits of providing air and fuel in an appropriate ratio include reduction of hydrocarbon emissions that typically are elevated when the air/fuel ratio is rich, reduction of nitrous oxides that typically are elevated when the air/fuel ratio is lean, and improvements in drivability and performance.

Ignition of the fuel may occur at a time prior to the piston 214 reaching top dead center (TDC) 1014 so that the fuel will burn shortly after the piston 214 reaches top dead center. The timing of ignition may also vary based on engine characteristics such as the quantity of air and fuel entering the cylinder 212 and the speed of the engine. Accordingly, basing ignition timing on the appropriate characteristics and their values at the appropriate time in the cylinder cycle may also beneficially influence engine operation.

Figure 2:
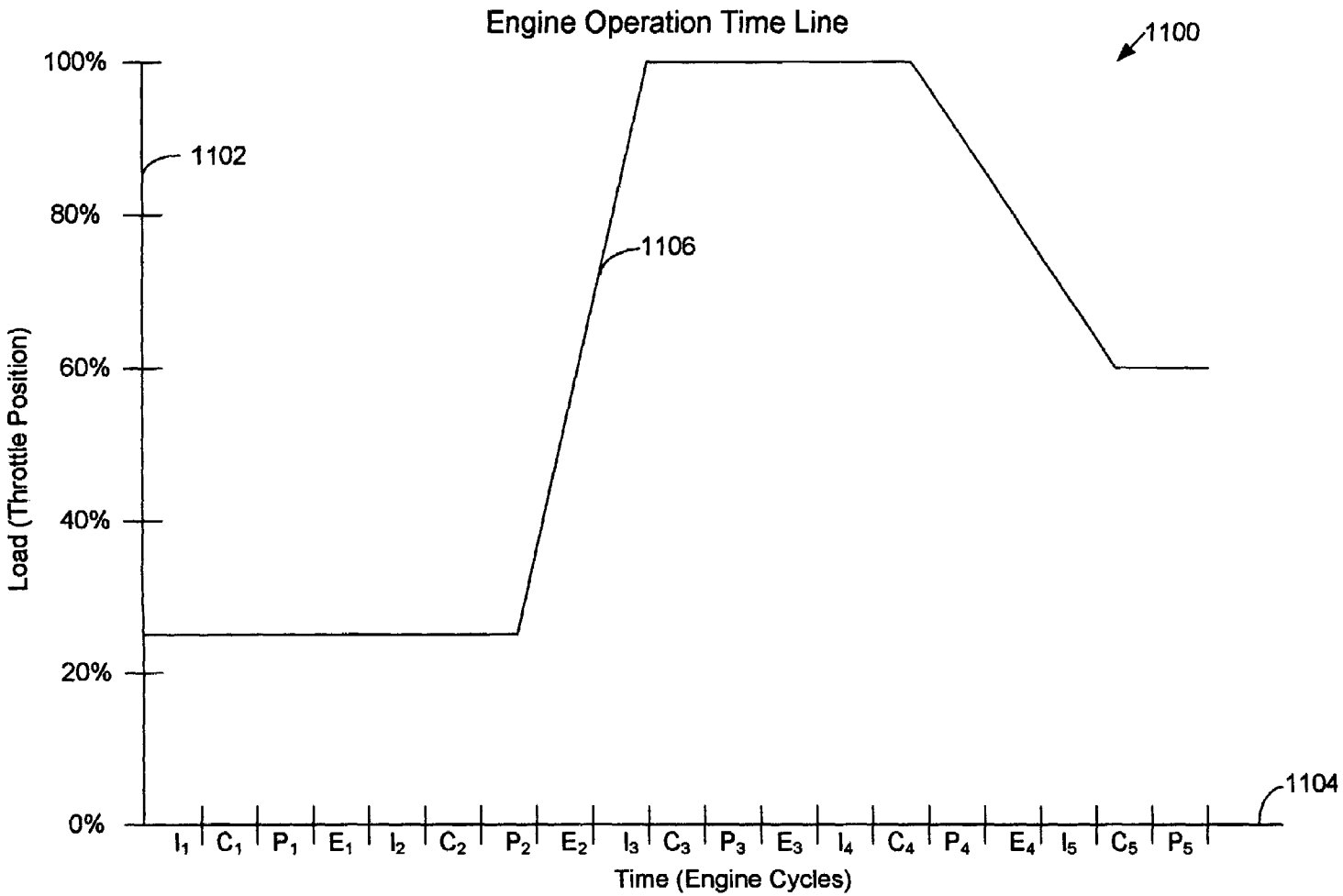
FIG. 2 illustrates an engine operation timeline.

FIG. 2 illustrates a sample engine operation timeline 1100. The vertical axis 1102 of the timeline 1100 indicates engine load, which may be sensed in any of the ways known to sense engine load, including, for example, a throttle position sensor 46, a manifold absolute pressure (MAP) sensor (not shown), or a mass airflow sensor 48 positioned to sense air flowing into one or more cylinders 212. In the example illustrated in FIG. 2, load is indicated by throttle position. The horizontal axis 1104 of the timeline 1100 indicates the passage of time as measured in engine cycles. As such, 11 indicates an intake stroke of a first engine cycle, C, indicates a compression stroke of the first engine cycle, $P_1$ indicates a power stroke of the first engine cycle, and $E_1$ indicates an exhaust stroke of the first engine cycle. 12, $C_2$, $P_2$, and $E_2$ indicate intake, compression, power, and exhaust strokes of a second engine cycle, respectively, and portions of additional engine cycles are indicated by subsequent subscripts. Throttle position 1106 is indicated over time. It should be recognized that a sensed or calculated value other than throttle position or engine load may be utilized in much the same fashion described herein and that the timeline may be represented with time on another axis or with more axes representative of two or more sensed or calculated values, as desired.

In the timeline of FIG. 2, the throttle is maintained at 25% through the first engine cycle and through the power stroke of the second engine cycle. During the power stroke of the second engine cycle, the driver or operator begins to move the throttle to 100%. The movement of the throttle is steady, occurs through the exhaust stroke of the second engine cycle, and concludes during the intake stroke of the third engine cycle. The operator then maintains the throttle at 100% until the exhaust stroke of the fourth engine cycle. Beginning during the exhaust stroke of the fourth engine cycle and continuing through the compression stroke of the fifth engine cycle, the operator moves the throttle to 60%.

The quantity of fuel to be delivered during a fuel injection event such as fuel injection event 1012 illustrated in FIG. 1, may be determined and the event may be scheduled prior to initiation of the fuel injection event 1012. The quantity of air that will be delivered during an air intake event, such as air intake event 1010 illustrated in FIG. 1, is determined by, for example, the engine valves, the engine speed, and the throttle position around bottom dead center of the intake stroke. With the fuel injection event 1012 beginning before the air intake event 1010, the engine operating conditions can change between the time the fuel injection event 1012 takes place and the time the air intake event 1010 takes place. Thus, where the engine operating conditions do change between the time the fuel injection event 1012 is scheduled and the time the air intake event 1010 takes place, there is likely to be a mismatch in the air fuel ratio supplied during that engine cycle.

Examples of engine operation where a mismatch in the air fuel ratio is likely, are shown in FIG. 2 where the throttle position is moved from 25% to 100% from the time of the second power stroke to the third intake stroke and where the throttle position is moved from 100% to 60% from the time the of the fourth compression stroke to the fifth compression stroke.

Examining the transition that begins during the second power stroke, the quantity of fuel provided during the second engine cycle is determined just prior to the exhaust stroke when the fuel injection event 1012 is scheduled to occur in this example, such that the fuel quantity to be supplied may be based on a 30% throttle position. The quantity of air provided in the next air intake event 1010 is determined during the intake stroke, such that the air quantity that will be supplied may be based on a 100% throttle position. Thus, the fuel provided would likely be lean and inadequate to create the desired air/fuel ratio with the air provided.

Similarly, where the throttle position is moved from 100% to 60% beginning during the compression stroke of the fourth engine cycle illustrated in FIG. 2, the quantity of fuel provided during the fourth engine cycle is again determined just prior to the exhaust stroke, such that the fuel quantity to be supplied may be based on an 87.5% throttle position. The quantity of air provided in the next air intake event 1010 is again determined during the intake stroke, such that the air quantity to be supplied may be based on a 100% throttle position. Thus, in that example the fuel provided would likely be rich and excessive, so as not to create the desired air/fuel ratio with the air provided.

It should be recognized that the engine speed may increase as and after the throttle position is moved from 25% to 100% and may decrease as and after the throttle position is moved from 100% to 60%. Conditions such as the engine driving a vehicle up an incline may, however, affect engine speed as well. Therefore, to simplify the illustration of the operation of this embodiment of engine combustion management in FIG. 2, the engine is illustrated as operating at a constant speed during the time depicted on the timeline 1100. The timeline 1100 illustrated in FIG. 2 may also be envisioned as representing an engine generating electrical power or a similar application, where it is desirable for engine speed to remain constant and for the quantities of fuel and air to vary to maintain constant engine speed through varying demands.

FIG. 3 illustrates an embodiment of a cylinder of a four-stroke engine 200 that may be utilized in connection with embodiments of predictive engine combustion management. It will be recognized that other cylinder configurations may be utilized with the predictive engine combustion management including, for example, two-stroke engines and configurations in which a fuel injector 162 supplies fuel to one or multiple cylinders 212 directly or through a port. The embodiment of FIG. 3 includes a fuel injector 162, an inlet tract 202, an inlet valve 204, a spark plug 206, an exhaust valve 208, an exhaust tract 210, the cylinder 212, and a piston 214 attached to a crankshaft (not shown) via a connecting-rod 216 and a bearing 218.

Pressurized fuel from the fuel line 164 illustrated in FIG. 3 may be sprayed through a nozzle 220 of the fuel injector 162 when a valve, such as an electrically operated solenoid valve (not shown) is opened, permitting fuel to flow through the fuel injector 162. That valve may be an electrically operated solenoid valve that is actuated through an output of the engine control unit 20 or engine control system 100.

Figure 5:
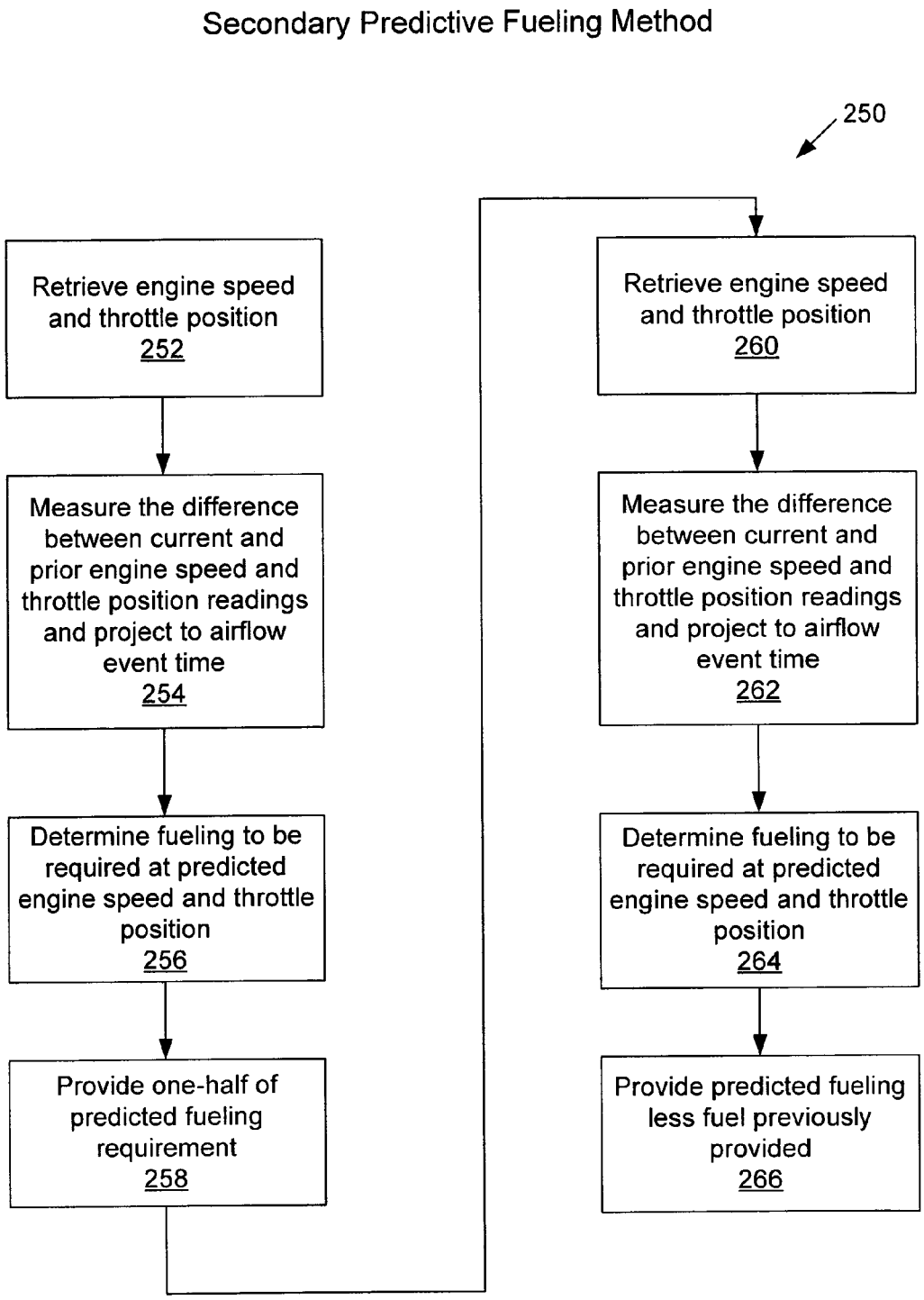
FIG. 5 illustrates a flow chart depicting an embodiment of a method for predicting fueling.

It should be noted that fuel delivered to the combustion chamber 212 passes through an inlet tract 202 where the fuel may be mixed with an oxidant, such as air, drawn through the inlet tract 202 by the movement of the piston 214 away from the inlet valve 204 and the exhaust valve 208. Engines may otherwise utilize direct injection in which fuel is injected directly into a cylinder 200 through a fuel injector 162 or other fuel supply device. In port injected cylinders or engines, as shown in FIG. 5, fuel is delivered to the inlet tract 202 leading to the inlet valve 204 and enters the cylinder 200 when the inlet valve 204 opens. In such engines utilizing an inlet tract 202, fuel may be provided both when the inlet valve 204 is open and when the inlet valve 204 is closed. The inlet valve 204 generally opens during the intake stroke in a four-stroke engine and fuel and air are provided through the inlet valve 204 at that time. Fuel may be provided to and gather in the inlet tract 202 during much of the remaining cylinder cycle when the inlet valve 204 is closed, to be provided to the cylinder when the inlet valve 204 opens. The ignition coil 58 may then create a spark at the spark plug 206 at an appropriate time in the cylinder cycle to ignite.

Figure 4:
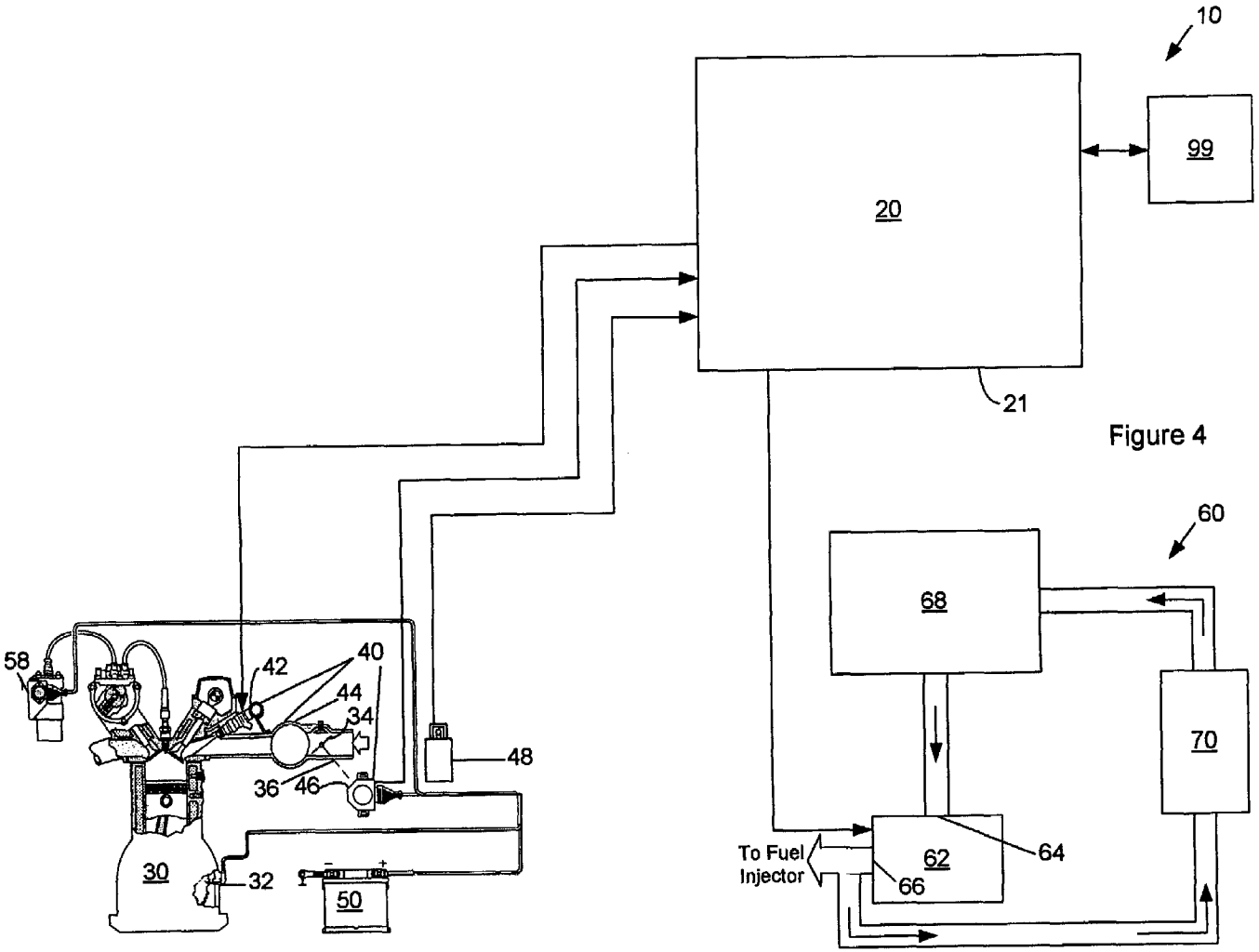
FIG. 4 illustrates an embodiment of a predictive engine combustion management system.

FIG. 4 illustrates an embodiment of a predictive engine combustion management system 10. The system 10 includes an engine control system 20, an engine 30, and a fuel delivery system 60.

The engine 30 depicted in the embodiment illustrated in FIG. 4 operates in conjunction with one or more fuel and air delivery devices 40. Fuel may be delivered through one or more fuel injectors 42 and air may be delivered through one or more throttle bodies 44 as illustrated in FIG. 4. A butterfly valve 34 may be utilized to control air flow into the engine 30. A throttle cable 36 may furthermore couple an actuator controlling the butterfly valve 34 to a throttle control device 46 that may have incorporated therein, as is shown in FIG. 3 or be coupled to a separate throttle position sensor. In another embodiment that may be referred to as "drive by wire," the butterfly valve 34 is controlled by an actuator that is actuated by way of a signal received from the engine control system 20. Alternately, air may be delivered through one or more other devices including, for example, a super charger.

The butterfly valve 34 may be positioned to permit airflow into the inlet tract 202 of one or more cylinders 212, such as those shown in FIG. 4, in that embodiment. The butterfly valve 34 may be pivotal about an axis between a first position preventing airflow into the inlet tract 202 and a second position permitting airflow into the inlet tract 202. An actuator, such as a cam (not shown), may be connected to the butterfly valve 34 for pivoting the butterfly valve 34, possibly against the bias of a return spring such as a torsion spring (not shown), from the first position to the second position. The actuator cam can be connected, via a throttle cable 36 to an operator controlled throttle control element such as the throttle and throttle position sensor 46. Alternately, the actuator cam for the butterfly valve 34 may be controlled by an output of the engine control unit 20 or engine control system 100 and the throttle control element may serve as an input to the engine control unit 20 or engine control system 100. The throttle position sensor 46 may, for example, be connected to the butterfly valve 44 for measuring the angular position of the butterfly valve 44 as it is pivoted about the axis, and/or may be connected to a throttle control element for input to the engine control unit 20 or engine control system 100.

The engine 30 depicted in the embodiment illustrated in FIG. 4 also operates in conjunction with a power source 50 that may be a battery, an ignition coil 58, a throttle position sensor 46 that indicates the current position of the throttle, an airflow sensor 48, and an engine encoder 32 that indicates the position of the engine 30 and may be used with the engine control system 20 to determine derivatives of position including engine speed and acceleration. Readings of values that have varying sampling frequencies, such as engine speed, may furthermore be filtered by a clock-tunable filter having a frequency that is varied in relation to the sampling frequency as is described in U.S. patent application Ser. No. 10/086,900.

The fuel delivery system 60 illustrated in FIG. 4 includes a fuel pump 62 having a fuel inlet 64 and a fuel outlet 66, a fuel tank 68 to contain fuel, and a pressure regulator 70 and may also incorporate other components known in the fueling technology including a coarse filter, a fine filter, and fuel lines interconnecting those components.

Table 1 shows an example of a map that includes an arbitrarily selected number of steady-state fuel quantity setpoints. Fuel quantity setpoints typically vary from one engine to any other engine, thus optimum fuel quantity setpoints are usually calibrated uniquely for each engine 30. Fuel quantity setpoints also generally vary for any particular engine 30 depending on the operating characteristic to be optimized, i.e., maximum power, minimum fuel consumption, emission regulations, etc.

An engine state may be defined by measuring the value of one or more operating characteristics of an engine. It is common practice in engine management that engine speed and load are used to define a matrix that may be viewed as a two-dimensional plane, wherein setpoints lie at the intersection of engine speed and load. It is also common for a controlled value such as engine fueling to be measured for a finite number of operating states. Thus, a map may include fuel values or setpoints corresponding to known engine states. In a two-dimensional map having a measurable characteristic corresponding to engine load as a first axis and a measurable characteristic corresponding to engine speed as a second axis, a setpoint for fuel may be defined at the intersection of the current engine load and current engine speed on the plane of the map. Alternately, or in addition, maps may provide ignition timing, exhaust gas recirculation (EGR) quantity, or other information utilized in engine operation.

Thus, the operating state of an engine 30 may be determined in many ways including measuring the speed of rotation of the engine 30 and the load on the engine 30. Engine speed is usually expressed in units of revolutions-per-minute or rpms. An embodiment of predictive combustion management also contemplates utilizing air mass per cycle delivered, or to be delivered, to an engine 30 or cylinder 212 to sense engine load. Each setpoint in Table 1 corresponds to the values of two engine operating characteristics such as, for example, an engine speed value and an engine load value. Thus, for a given value of engine speed that may be sensed by or derived from an output signal from a crankshaft angular motion sensor 32 coupled to an engine 30 or as otherwise sensed and for a given value of engine load, fuel quantity setpoints may be assigned in a map and may be read therefrom. For example, the map illustrated in Table 1 causes the engine control system 20 to deliver twenty-five grams of fuel during a cylinder cycle when the engine is operating at 2000 revolutions per minute (rpm) and when the throttle is opened 50%. At 5000 rpm, when the throttle is fully open, the engine control system 20 will vary fuel delivery to provide fifty grams of fuel per cycle. Thus, when either the engine load (e.g., throttle position) or engine speed changes, the fuel delivery system 60 will determine an initial, steady-state amount of fuel that is to be delivered at the new speed and load by reference to the map.

TABLE 1

| Fuel Delivery | | Engine speed (revolutions per minute) | | | |
|---|---|---|---|---|---|
| (milligrams per cycle) | | 1000 | 2000 | 5000 | 7000 |
| Load | 5 | 7 | 5 | 4 | 3 |
| (Percentage | 25 | 10 | 21 | 15 | 10 |
| Throttle | 50 | 15 | 25 | 37 | 30 |
| Opening) | 75 | 15 | 25 | 44 | 40 |
| | 100 | 15 | 25 | 50 | 45 |

In general, a map will include a greater number of setpoints than illustrated in the map of Table 1. Those setpoints can be assigned for small increments of measured value for each engine operating characteristic utilized in the map. If the operating state of the engine falls in a gap between specified values of the characteristics (e.g., in Table 1, there are gaps of 2000 rpm or more between the specified values for engine speed and 20% or more gaps in engine load), the engine control system 20 can interpolate the operating control values between the setpoints in the speed columns and load rows between which the current speed and load values lie. Thus, the map of Table 1 is included as a simple example to illustrate predictive fueling.

As discussed in connection with FIGS. 1 and 2, each combustion event in an internal combustion engine is predicated on pre-combustion activities occurring over time prior to each combustion event. As has been discussed, fuel and air may be placed by injection or otherwise in a cylinder 212 during the intake stroke. Fuel may furthermore be placed in an inlet tract 202 leading to the cylinder 212 prior to the intake stroke. Because activities occur over time prior to the combustion event that at least partially determine the characteristics of the combustion event, an embodiment of engine combustion management predicts one or more combustion related characteristics that are likely to exist at the time of the combustion event and controls one or more of the pre-combustion activities in accordance with the predicted characteristic.

Table 2 illustrates a beginning of injection table that may be used to determine the angle of rotation in the 4-stroke cycle at which the fuel injector will be activated. A typical order of events might be to determine a quantity of fuel to be provided, then schedule the angle at which fuel injection will begin. Thus, it may be seen that fuel decisions may take place early in an engine cycle.

TABLE 2

| Beginning of Injection (angle of rotation) | | Engine speed (revolutions per minute) 1000 | 2000 | 5000 | 7000 |
|---|---|---|---|---|---|
| Load (Percentage Throttle Opening) | 5 | 540 | 480 | 360 | 240 |
| | 25 | 530 | 470 | 350 | 230 |
| | 50 | 520 | 460 | 340 | 220 |
| | 75 | 500 | 440 | 320 | 200 |
| | 100 | 480 | 420 | 300 | 180 |

In an embodiment of predictive combustion management, to predict a future state or associated value of a characteristic to be considered in a combustion event, two or more readings are taken and the velocity of change in the value is determined. For example, throttle position may be sensed by use of a sensor such as the throttle position sensor 46 providing a signal to an engine control device such as the engine control system 20 at two or more times during a cylinder cycle. Two or more throttle position readings may be read or derived over time to determine the velocity of throttle position change. Engine speed may similarly be sensed by use of a sensor such as the engine encoder 32 or a crankshaft angular motion sensor providing a signal to the engine control system 20 at two or more times during a cylinder cycle. Throttle position and engine speed may then be projected or predicted for a future time in the cycle or a future engine position, for example at or near the end of the next airflow evet. Predictive fueling may thus be referred to as feed-forward fueling since it is calculating future values rather than waiting for feedback from a sensor before recognizing a change in condition.

A future position of the engine may furthermore be determined by taking two or more readings of engine position, determining velocity, acceleration or another derivative of engine position, and calculating from the current engine position using a derivative of engine position such as speed or acceleration, when the engine will be at the desired future position. That desired future engine position may furthermore be the position at which the quantity of airflow that will be received into the cylinder will be determined, such as near the end of the next intake stroke. In that way, a fuel quantity, for example, may be determined and provided based on the throttle position and engine speed that will or should exist when the airflow quantity is determined, thereby matching fuel to air during a transition in engine operating condition.

Those predicted future values may, for example, be utilized in accessing a steady-state map, such as illustrated in Table 1, so that an appropriate steady-state fuel quantity may be delivered to match the engine speed and throttle position predicted to exist when the next airflow event occurs. Maps other than steady-state maps may alternately be used in such a look-up procedure. A fuel quantity setpoint may then be selected from the map based on the predicted engine speed and throttle position and that fuel quantity may be delivered. Where a steady-state or other map is utilized, the fuel quantity delivered may furthermore be modified as described in connection with U.S. Pat. No. 6,701,897 entitled "Engine Fuel Delivery Management" and described in part herein, to account for fueling changes that may be desirable to compensate for transitions in engine load or speed. In addition, a filter, such as that described in U.S. Provisional Patent Application No. 60/537,227 entitled Dynamic Filter and described in part herein, may be applied to the predicted states or values.

In an embodiment, velocity may be calculated from two readings by determining the difference between the readings and dividing that difference by the time that elapsed between the readings. In an embodiment wherein multiple readings are made during a cylinder cycle, various velocity calculations may be made such as average velocity or weighted average with more weight placed on calculations made in connection with later readings, for example.

In an embodiment acceleration, or the change in velocity over time may be determined from a plurality of readings by, for example, calculating the derivative of velocity over time, and acceleration may be used to predict a future position, speed, or other desired value. Alternately, other functions may be applied to the sensed values to predict a value at an appropriate future time.

An embodiment of predictive combustion management predicts engine conditions at an appropriate time of the cylinder cycle, calculates appropriate fuel delivery to match airflow under transitory conditions, and compensates for changes in fuel delivered from collateral sources by varying fuel flow from the injectors during transitory engine operation. In one embodiment, predictive combustion management senses engine speed and throttle position, predicts engine speed and throttle position at a time when the next air intake event 1010 is likely to be terminating, reads or interpolates an associated quantity of fuel from a look-up table or map that is to be delivered to a cylinder 212 during the next engine or cylinder cycle for the predicted engine conditions, and adjusts that fuel quantity to account for the transition occurring.

Quantity of fuel is expressed in Table 1 as a fuel mass per cylinder cycle to be delivered. The values retained within the map may, however, be expressed in terms other than fuel quantity or mass. For example, the value saved in the map may be an amount of time that an injector should be held open to deliver a desired quantity of fuel in, for example, a pulse width modulated system. The value may also correspond to fuel pressure, airflow rate, or a degree of injector opening, for example. It should be noted that fuel mass delivered per cycle may decrease as engine speed increases, however, the rate of fuel delivery per time unit, such as per second, may still increase because of the increased number of cycles.

Thus, an embodiment of predictive engine combustion management receives sensed data indicating current engine speed from a signal transmitted from an engine encoder 32 or other sensor and receives sensed data indicating current load from a signal transmitted from a throttle position sensor 46 or other sensor at an engine control system 20. The engine control system 20 may receive those sensed signals a plurality of times during each engine cycle and may utilize any or all of those received signals. The current readings may be compared to past readings and velocity of throttle movement, acceleration of engine motion, or another derivative of engine speed, load or another engine characteristic or calculated value may be calculated. Engine speed and load at a later time in the cylinder cycle, such as at the time when the next air intake event 1010 is likely to be terminating, may then be calculated from current or previous engine speed and load and the projected change in speed and load. The steady-state fuel setpoint value may then be read from a fueling map for the predicted engine speed and load.

Thus, a form of predictive fueling may be utilized to select a more accurate steady-state fuel quantity from a map so that the amount of the fuel quantity change provided by a transient fueling system may be reduced, or even eliminated, thereby providing a fuel quantity that is more closely aligned with the engine operating condition at the time of the combustion event.

Ignition timing, valve opening or closing times, exhaust gas recirculation quantity, or other engine operational aspects or physical components may alternately or additionally be controlled based on predictions of one or more engine states, characteristics, or operational levels such as engine speed and load.

For example, ignition timing may vary based on engine speed, throttle position, both engine speed and throttle position, or other engine operating characteristics. It may also be desirable for ignition timing to be determined, at least in part in accordance with the quantity of fuel and air provided in that cylinder cycle and in accordance with the engine speed at the time of ignition. Ignition timing in a conventional engine control system may, however, be determined at a time prior to or after the air intake event takes place and before ignition takes place. Thus, an embodiment of predictive combustion management selects appropriate ignition timing from a map, or otherwise, based on engine operating characteristics at appropriate times in the past or future.

Thus for example, an embodiment of predictive combustion management is utilized to control ignition timing based on a throttle position that exists at the end if the intake stroke and on an engine speed that exists at the time ignition takes place. In that embodiment, the time that ignition will take place is scheduled prior to ignition actually occurring. Thus, if ignition is scheduled during the intake or compression stroke, for example, the future speed of the engine at the time of ignition may be predicted as described herein in connection with fueling, and the actual throttle position that existed at the end of the intake stroke may be used to schedule ignition timing. Alternately, if ignition is scheduled prior to scheduling the air intake event, ignition timing may be based on the throttle position predicted to exist at the time the air intake event is to occur and the engine speed predicted to exist at the time ignition is to occur.

Predictive fueling may also take into account delays, such as delays in the reaction of sensors. For example, when it is know that a sensor is slow to react to a change in sensed media, an embodiment of predictive fueling may take the current sensed value and a previous sensed value, determine the rate of change in the value or another derivative of the change in sensed value over time, and predict the actual current value that should be sensed or a value that is likely to exist at a time in the future.

The process of predicting one or more values on which fueling relies may be repeated with values sensed at two or more times during the fuel delivery cycle. Repeating the prediction process during the fuel delivery cycle enables the fuel quantity provided to be altered after a portion of the fuel has already been provided, thereby fine tuning the quantity of fuel provided utilizing current values and rates of change closer to the desired time, which may be when the next air intake event 1010 is likely to be terminating. That process of providing two or more fueling requirement predictions may be referred to as secondary injection and may be applied during all fuel delivery cycles or during fuel delivery cycles occurring under particular conditions such as when the engine speed is in the lower part of its range. Accordingly, in certain embodiments, engine speed or load may be predicted two or more times prior to a combustion event and those two or more predictions may take place prior to or during fueling.

In an embodiment, fuel is delivered during the cylinder cycle in portions of the total required for an upcoming combustion event. Engine speed and load at the time when the next air intake event 1010 is likely to be terminating may be predicted two or more times or throughout a cycle of a cylinder, and portions of the total fuel to be delivered during the cycle may be delivered after some or all of those calculations. For example, in an embodiment of engine combustion management, the position of the throttle and speed of the engine may be predicted twice during a 4-stroke cycle in an engine having an inlet tract through which fuel flows to an inlet valve. The throttle position and engine speed may be predicted at an appropriate time in the 4-stroke cycle, such as when the next air intake event 1010 is likely to be terminating or near the end of the next intake stroke 1002. Half or another desired portion of the total fuel required for the predicted throttle position at the predicted engine speed may then be delivered to the inlet tract where it may remain until the inlet valve opens. At a later time in the cylinder cycle, throttle position and engine speed may be predicted again, and from those predicted values, a new predicted total fuel requirement may be calculated. The difference between this new predicted total fuel requirement and the fuel amount initially delivered may then be delivered to the inlet tract. Recognizing that delivering fuel takes time, that split delivery type of system may deliver a portion of the initially predicted total fuel requirement early in the cylinder cycle, then refine that total later in the cycle when that total is likely to be more accurate. Based on this new predicted total, the secondary predicted delivery system may then deliver another fuel quantity that is likely to be closer to the actual fuel quantity needed.

In another embodiment of engine combustion management, throttle position and engine speed, and thus the total fuel requirement, may be predicted ten times during a four-stroke cycle. Fueling may be performed in several ways, such as by delivering one tenth of the predicted fuel after each prediction is made, or by weighting the fuel portions delivered toward the earlier or later predictions. In another example, the fuel quantity provided after each prediction will be one tenth of or otherwise based on the following fuel amount: the predicted fueling requirement plus the total fuel that would bave been previously delivered under that requirement minus the actual total fuel previously delivered.

FIG. 5 illustrates a flow chart depicting an embodiment of a method for predicting fueling 250 that may be performed by, for example, a processor in an engine control unit or other engine control device. That embodiment predicts fueling requirements twice during a cylinder cycle and provides fuel twice in accordance with those predictions. At 252, current engine speed and throttle position are retrieved at a time after the intake stroke and compared to previous values of engine speed and throttle position. Current engine speed and throttle position may be sensed by, for example, retrieving most recently received signals. Those signals may have been received from sensors such as the engine encoder 32 and throttle position sensor 46 illustrated in FIG. 4 and converted to values corresponding to engine speed and throttle position by the processor or another device such as a separate processor or circuit that may reside on an input/output board. It should be recognized that any sensed or calculated data that indicates current engine operating level or desired engine operating level may be utilized in place of engine speed and throttle position.

In one embodiment of predictive fueling, a fueling map may be used. For example, referring to the map of Table 1, which provides simplified fueling map values, a previously sensed engine speed is determined to be 1000 rpm and a previously sensed throttle position is determined to be 25%, such that 10 mg of fuel would be the steady state quantity of fuel corresponding to the previous engine speed and throttle position. Those previously sensed engine speed and throttle position will be assumed to have been sensed just prior to the intake stroke, corresponding to 0 degrees in a 4-stroke cycle, in this example.

Following with this example, at 254, the engine speed and throttle position are examined every 240 degrees. Fuel injection events are to be scheduled at 240 degrees and 480 degrees. At 0 degrees, the engine speed was found to be at 1000 rpm and the throttle position was found to be 25%. At 240 degrees of rotation into the current cylinder cycle, engine speed is retrieved and found to be 1025 rpm and throttle position is retrieved and found to be 31.5%. The change in engine speed is thus 1020 minus 1000 rpm, or 20 rpm, and the change in throttle position is 31.5% minus 25%, which is 6.5%. Assuming for this example that the airflow quantity to be matched will occur at 180 degrees into the next cycle, at the end of the intake stroke, the predicted point in the cycle would be 720 degrees per cycle less 240 degrees into the cycle plus 180 degrees into the next cycle, which is equal to 660 degrees from the current location in the engine cycle. Using Equation 1, which follows, the throttle position predicted to exist at 180 degrees would be approximately 43%. Using Equation 2, which follows, the engine speed predicted to exist at 180 degrees would be 1055 rpm. To simplify the calculations in this example, the table values are not interpolated and the closest value is the one that is used as a result, the 50% throttle position will be selected from the table for the 43% throttle position that was calculated and the 1000 rpm engine speed will be selected from the table for the 1055 rpm that was calculated.

A threshold will be applied to the change in value or the predicted change over a cycle in this example. For example, a threshold of 100 rpm will be applied to the predicted change so that at least a change of 100 rpm would be required for the change to be considered. If the threshold is not exceeded, as it is not in this example, then the previous engine speed would and will be utilized in the fueling determination at 240 degrees in the cycle. Similarly, a threshold could be applied to the throttle change and could be, for example, 2%, which has been exceeded in this example. In an embodiment not utilized in this example, if either threshold is exceeded, both the engine speed and throttle position changes could be considered. Global or local thresholds may furthermore be applied to all or any subset of values or states being predicted. Thresholds may be utilized to minimize changes caused by signal "noise" or unintentional variations in pressure applied to the throttle by an operator, for example.

At 256, the steady-state fuel quantity to be provided at the predicted engine speed of 1000 rpm and throttle position of 50% may be determined by reference to Table 1. Table 1 indicates that at an engine speed of 1000 rpm and a throttle position of 50%, 15 mg of fuel would be provided to the cylinder. Because another, and likely more accurate, prediction will be made later in the current cylinder cycle, and additional fuel will be provided at that time, one-half of the 15 mg of fuel, which is 7.5 mg, may be utilized as a current steady-state fuel quantity and provided at that time. That steady-state fuel quantity may then be modified as described in U.S. Pat. No. 6,701,897 to correct fueling for the transition occurring if so desired and the resulting fuel may be provided to the cylinder at 258.

A situation wherein throttle position increases significantly while engine speed increases a lesser amount may occur where throttle position has recently changed and engine speed has not yet increased to a steady-state speed that would correspond to the change in throttle position or where a steep hill is encountered and maintaining engine speed requires additional fueling, for example.

Fuel provided at 240 degrees in a 4-stroke engine cycle may be held in an inlet tract 202 until the inlet valve 204 opens, thereby allowing the fuel to enter the cylinder 212.

At 260, at approximately 480 degrees of engine rotation into the cylinder cycle, engine speed is read at 1600 rpm and throttle position is read at 38% in this example.

At 262, the change in engine speed since the considered reading at 240 degrees is determined to be 1600-1000 rpm, or 600 rpm. That change also occurred over 240 degrees. The engine speed predicted at the time of the next combustion event would therefore be 2050 rpm. The 1050 rpm change surpasses the 100 rpm threshold and is therefore utilized in the prediction of engine speed at the next combustion event.

The change in throttle position since the last combustion event in this example is 38%-31.5%, which is 6.5%. The throttle position predicted at the time of the next combustion event would therefore be 43%. That change again exceeds the throttle position threshold applied in this example so that the predicted throttle position of 50% is utilized in the current fueling determination.

At 264, referring to Table 1, at an engine speed of 2000 rpm and a throttle position of 50%, the quantity of fuel to be provided is 25 mg of fuel. Because 7.5 mg of fuel have already been provided to the engine at 240 degrees of rotation into the current combustion cycle, the currently predicted required fuel quantity of 25 mg less the previously provided 7.5 mg of fuel, or 17.5 mg of fuel may be utilized as a current steady-state fuel quantity for the second injection of fuel. That quantity of fuel may then be provided at a point in the cycle commensurate with the setpoints in Table 2, which would be 540 degrees in this example. That steady-state fuel quantity may then be modified as described in U.S. Pat. No. 6,701,897 to correct fueling for the transition occurring if so desired and the resulting fuel may be provided to the cylinder at 266 for firing at the time of the next combustion event.

In that way, partial fueling for an upcoming combustion event may be predicted and provided early in the combustion cycle and the remainder of fuel desired may be more accurately predicted and provided later in the combustion cycle, when there may be too little time to provide the entire fueling charge needed.

In predicting fuel quantity to be provided for combustion, predictive engine combustion management may consider a variety of characteristics including the sensitivity of the engine to fueling changes and the amount of the fuel change requirement predicted. The amount of change in the operating state of an engine may be expressed in terms of a change in a setpoint associated with a steady-state fueling value for an engine, engine load, engine speed or one or more other sensed or calculated values that indicate the state of the engine. The equations included below utilize the velocity of change in throttle position and velocity of change in engine speed, also known as engine acceleration, over a portion of a cylinder cycle to predict the state of the engine and required fueling at the next cylinder cycle.

It should be noted that variables including the cycle portion "CP" or elapsed time between the previous throttle position reading "PTPS" or previous engine speed reading "PES" and the current readings "CTPS" and CES," respectively, may be different for throttle position and engine speed and may differ for any other sensed characteristic used in addition to or in place of throttle position and engine speed. Moreover, predictions may be determined using weighting or otherwise over an elapsed time or duration by use, for example, of proportional and integral "PI" or proportional, integral, and derivative "PID" control strategies.

Thus, throttle position at a future time in a cylinder or engine cycle, such as the time when airflow will end, may be calculated as follows:

$$FTPS=CTPS+((CTPS-PTPS)/CP)*RP \quad \text{Equation 1}$$

Where:

FTPS is the throttle position predicted to exist at a future time, such as at a next air intake event;

CP is the portion of a cylinder or engine cycle that has elapsed between the previous reading and the current reading;

RP is the portion of a cylinder or engine cycle that is yet to elapse before the future time arrives;

CTPS is the current or most recent reading of throttle position; and

PTPS is a previous reading of throttle position.

Engine speed at the time of the next combustion event may also end as follows:

$$FES=CES+((CES-PES)/CP)*RP \quad \text{Equation 2}$$

Where:

FES is the engine speed predicted to exist at a future time, such as at a next air intake event;

CP is the portion of a cycle that has elapsed between the previous reading and the current reading;

RP is the portion of a cylinder or engine cycle that is yet to elapse before the future time arrives;

CES is the current or most recent reading of engine speed; and

PES is a previous reading of engine speed.

Alternately, a future engine state may be estimated by use of current and previous steady-state fueling values using an equation similar to one of those described above with past and current fuel quantities supplied in place of throttle position or engine speed.

It will be recognized that, regardless of the fuel calculation method, when the engine is moving toward a state requiring less fueling, the predicted fuel quantity may be less than the fuel quantity provided for the last combustion event. In that way, predictions for both increases and decreases in fuel delivered may be provided by predictive fueling. Alternately, increases and decreases in fueling quantity may be handled differently where desired, such as in a racing application where reductions may be minimized, while increases may be maximized.

Engine speed may be sensed in various ways including a crankshaft angular motion sensor 32, an engine encoder, or another type of engine speed sensor. Where a crankshaft angular motion sensor 32 is used, for example, the crankshaft angular motion sensor 32 may, for example, sense the passage of teeth, reflective strips or other shapes or markings on, for example, a flywheel, rotor 56, or other gear coupled to the crankshaft by use of, for example, an optical or magnetic sensor. Where the crankshaft angular motion sensor 32 utilizes teeth, the crankshaft angular motion sensor 32 may have many teeth, such as one tooth per degree of rotation or on tooth per ten degrees of rotation and may calculate speed approaching instantaneous speed as each tooth or each edge of each tooth is encountered and sensed. Alternately, the crankshaft angular motion sensor 32 may have as few as one tooth and it may sense passage of a leading edge and/or a trailing edge of the tooth and calculate the speed of crankshaft rotation from the leading edge to the trailing edge, from the trailing edge of the leading edge, for the leading edge to the next leading edge, and/or from the trailing edge to the next trailing edge.

Where one or few shapes or markings such as teeth indicating the rotational position of the engine are utilized, the speed of rotation between the edges of the markings or shapes may correspond to any portion of a cycle such as a 360 degree cycle. Therefore, the speed at the desired portion of the combustion cycle, such as during the fuel delivery cycle, may be calculated from a complete cycle or a portion of a crankshaft cycle. For example, where the crankshaft angular motion sensor 32 includes one tooth with a leading edge at 60 degrees before top dead center and a trailing edge at top dead center for a given cylinder, engine speed may be calculated for a 4-stroke combustion cycle by, for example determining the elapsed time from the passage of the trailing edge at top dead center of a combustion cycle to passage of the trailing edge two crankshaft cycles later. Those two rotations may then be divided by the elapsed time in minutes to determine rpm for that combustion event.

The speed may also be calculated from the elapsed time between the passage of the last two edges of the crankshaft angular motion sensor 32 prior to the time when fueling is to begin. Thus, for example, if the leading and trailing edges were the last to pass before fueling is to begin, the speed may be determined by dividing 360 degrees of rotation by the 60 degrees of rotation between the leading and trailing edges and dividing the result by the elapsed time between the passage of the leading edge and the trailing edge. That speed may further more be modified to account for differences in speed that typically exist during a combustion cycle.

The speed of an engine typically varies throughout a combustion cycle and that variation is typically more pronounced in a single cylinder engine and less pronounced as the number of cylinders increases. Using a single cylinder engines as an example, the speed of rotation may, for example, be slower during the compression stage than during the ignition stage. However, the speed during the period when engine speed was last calculated before fueling occurs and the speed during the fueling may typically be relatively constant portions of a total cylinder cycle. Therefore, by extrapolation or utilizing a function that accounts for engine speed during different portions of the combustion cycle, speed during an upcoming combustion event or at another desired time in the combustion cycle may be calculated from speed at another time during the combustion cycle.

It should be recognized that engine speed may be determined over various periods. For example, engine speed may be determined instantaneously, over 360 degrees of rotation, over the 720 degrees of rotation corresponding to a engine cycle in a 4-stroke engine, or as a filtered speed over more than one engine cycle. A speed approaching instantaneous speed may be determined, for example, by sensing the speed of the engine over a single degree of rotation when the speed sensor utilized is capable of sensing a single degree of rotation. Filtered speed may be determined by taking an average, a weighted average or another function of speed over two or more combustion cycles.

Figure 6:
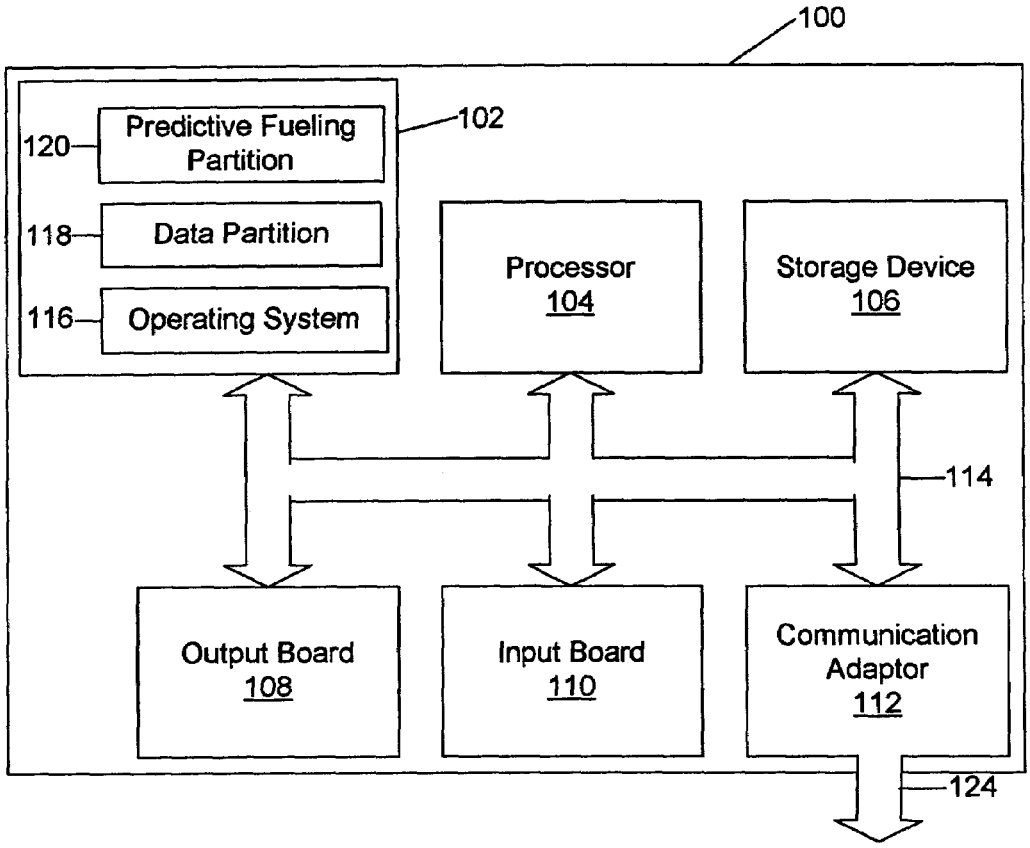
FIG. 6 illustrates an embodiment of an engine control system that may be utilized in connection with predictive engine combustion management.

FIG. 6 illustrates an embodiment of the engine control system 100 that includes memory 102, a processor 104, one or more output boards 108, and one or more input boards 110, and may include a storage device 106 and one or more communication adaptors 112. That engine control system 100 may, for example, be utilized as or in the place of the engine control system 20 illustrated in FIG. 4. Engine control devices and systems in other forms may alternately be utilized in embodiments of predictive engine combustion management. For example, an engine control system having two or more processors operating to control engine operation may be utilized in embodiments of predictive engine combustion management or an engine control device other than a traditional engine control unit may be utilized in embodiments of predictive engine combustion management.

Communication between the processor 104, the storage device 106, the output boards 108, the input boards 110, and the communication adaptors 112 may be performed by way of one or more communication busses 114. Those busses 114 may include, for example, a system bus, a peripheral component interface bus, and an industry standard architecture bus.

The memory 102 may include any memory device including, for example, random access memory (RAM), dynamic RAM, and/or read only memory (ROM) (e.g., programmable ROM, erasable programmable ROM, or electronically erasable programmable ROM) and may store computer program instructions and information. The memory may furthermore be partitioned into sections including an operating system partition 116 in which operating system instructions are stored, a data partition 118 in which data is stored, and a predictive fueling partition 120 in which instructions for carrying out predictive fueling are stored. The predictive fueling partition 120 may store program instructions and allow execution by the processor 104 of the program instructions. The data partition 118 may furthermore store data such as one or more maps or operating parameters to be used during the execution of the program instructions.

The processor 104 may be as manufactured by Motorola, Intel, or AMD, for example, and may execute the program instructions and process the data stored in the memory 102. In one embodiment, the instructions are stored in memory 102 in a compressed and/or encrypted format. As used herein the phrase, "executed by a processor" is intended to encompass instructions stored in a compressed and/or encrypted format, as well as instructions that may be compiled or installed by an installer before being executed by the processor 104.

The storage device 106 may, for example, be a magnetic disk (e.g., floppy disk and hard drive), optical disk (e.g., CD-ROM) or any other device or signal that can store digital information. The communication adaptor 112 permits communication between the engine control system 100 and other devices or nodes coupled to the communication adaptor 112 directly or through a network at the communication adaptor port 124. The communication adaptor 112 may be a network interface that transfers information from one or more nodes on a network to the engine control system 100 or from the engine control system 100 to one or more nodes on the network. The network may be a local or wide area network, such as, for example, the Internet or the World Wide Web. The engine control system 100 may alternately or in addition be coupled directly to one or more other devices through one or more input/output adaptors (not shown).

The engine control system 100 may be implemented alone or in a network. A network in which predictive fueling may be implemented may be a network of nodes, which are typically processor-based devices, interconnected by one or more forms of communication media. The communication media coupling the engine control system 100 to one or more other devices or a network may include, for example, wire, twisted pair, co-axial cable, optical fibers and wireless communication methods such as use of radio frequencies. The engine control system 100 may furthermore be coupled to other devices such as sensors and actuators by those forms of media. A node performing predictive fueling may receive signals or data from another engine control node and may modify or otherwise utilize those signals or data. A node performing predictive fueling may also transmit signals or data to another engine control node where the signal or data may be modified or utilized.

It should be recognized that any or all of the components 102-124 of the engine control system 100 may be implemented in a single machine. For example, the memory 102 and processor 104 might be combined in a state machine or other hardware based logic machine.

Referring again to FIG. 4, a library of maps or engine management files may be stored in the external computer 99. An example of such an external computer may be found in U.S. Pat. No. 6,512,974 and an example of a coupler for the external computer 99 may be found in U.S. Pat. No. 6,483,444. One or more of those maps or engine management files may be made available to the engine control system 20 from the external computer 99 or otherwise be contained in the engine control system 20, and can be used to alter engine performance. The engine control system 20 may be coupled to one or more input or output devices such as sensors or actuators by way of wires, fiber, wirelessly, or another coupling device or method. The engine control system 20 may include input and output devices that may be internal or external to the engine control system 20 for coupling of sensors or actuators. The sensors may include, for example, the throttle and throttle position sensor 46 and air flow sensor depicted in FIG. 4 and the actuators may include, for example, an actuator coupled to the fuel injector 42 as depicted in FIG. 4. The engine control system 20 may include a processor such as the processor 104 shown in FIG. 6, and that processor 104 may use coded instructions to act on one or more input signals and to supply one or more output signals. According to one embodiment, wires electrically connect the engine control system 20 with various other components, such as those described in detail below. The engine control system 20 may have a housing 21 mounted to a vehicle chassis (not shown) through which other components can be electrically grounded with respect to the vehicle chassis or frame in a known manner.

According to one embodiment of predictive engine combustion management, the engine control system 20 can provide a single engine operating control value, i.e., for adjusting a single engine control, such as fuel quantity delivery. According to another embodiment, however, the engine control unit 20 can provide a plurality of engine operating control values, i.e., for controlling a plurality of engine controls, such as fuel quantity and ignition timing.

In addition, the engine control unit 20 can also be coupled to other on-board sensors. For example, an air-temperature sensor (not shown) and/or barometric pressure sensor (not shown) can provide sensor signals that can in turn be used to calculate the density of the air being inducted into the engine 100. Because the displacement of an engine is typically constant and mass of combustion air is equal to the displacement times the density of the combustion air, the mass of combustion air may be calculated. Thus, inlet temperature and pressure can be used to affect global changes to all control signals based on the values in each map set that has been downloaded to the engine control unit 20. A map may, therefore, include fuel mass requirements under standard atmospheric conditions and the engine control unit 20 may compensate for various atmospheric pressures, temperatures, or other sensed media or characteristics that, for example, affect air density and air mass entering the cylinder 212.

Additionally, a sensor (not shown) for electrical system voltage can measure variations that affect the reaction time and accuracy of the electromechanical movements within the fuel injectors 312.

An embodiment of a predictive combustion device includes a data acquisition unit having one or more inputs, one or more outputs, and a processor. The data acquisition unit utilized may be an engine control unit 20 or an engine control system 100 as illustrated in FIG. 4 or 6.

An input of the data acquisition unit may be for receiving a signal from a first sensor related to a characteristic to be considered in a combustion event. The sensor may, for example, sense engine load or engine speed. The signal incident at the input may be related to any characteristic to be considered in the combustion event. The sensor may be coupled to the input to make the signal incident at the data acquisition unit input.

An output of the data acquisition unit may be for transmitting a signal to a first actuator related to a physical component of the combustion event. The actuator may control delivery of a physical component of combustion or an aspect of such a physical component. The actuator may, for example, control fuel delivery, air delivery, exhaust gas recirculation delivery, or spark delivery, or an aspect thereof. The signal incident at the output may thus be related to any physical component of combustion. The actuator may be coupled to the output to transmit the signal incident at the data acquisition unit output to the actuator.

The processor of the data acquisition unit may contain instructions that may take the form of a computer program. The processor may furthermore execute those instructions. When executing the instructions, the processor may predict a future state of the characteristic to be considered in the combustion event and provide the signal at the output related to the physical component of the combustion event based on the predicted state of the characteristic. The state of the characteristic may be a value related to a sensed analog signal or one of two or more predefined states. The processor may predict a future value or state of the characteristic by receiving at least two values from a sensor coupled at the input of the data acquisition unit. The processor may then utilize those at least two values or states and comparative time of receipt of the at least two states to determine a rate of change of the states received from the first sensor. The comparative time may be a quantity of time elapsed between the receipt of the first state and the receipt of the second state.

It should be recognized that two states may be values and those values may be the same value. In such a circumstance, the predicted value may be equivalent to the sensed values. The processor may further accomplish the prediction by determining a first, second, or further order derivative of the characteristic value and may utilize any number of such derivatives in predicting the future value of the characteristic.

The processor may also predict the future state of the characteristic two or more times prior to a combustion event and may also provide the output signal two or more times prior to a combustion event, thereby causing the physical component to be delivered two or more times prior to a particular combustion event. A portion of the total physical component predicted to be appropriate for the combustion event may furthermore be provided each time the physical component is provided so that, for example, half of the quantity of the physical component predicted to be required may be provided at or after the time of the first prediction and the remaining quantity of the physical component may be provided at or after the time of the second prediction. The physical component may be provided any desired number of times leading up to a combustion event and divisions of predicted physical component may be made in a weighted way or any other way desired.

The processor may furthermore perform any method and be utilized in any apparatus or system described herein. Any of the methods described herein may furthermore be coded as instructions and stored on a computer readable medium such that the instructions may be accessed and executed by a processor to be utilized in any apparatus or system described herein.

Predictive fueling may be beneficial not only in engine operation, but also in engine calibration. Engine calibrating may include determining fuel quantities to reside in the fueling map or table. Certain existing engine control systems may use "schedule time" information from prior to the beginning of engine fuel delivery to determine fuel quantity and so may not provide a fuel quantity that is desirable at the "execution time" or the time of the combustion event. The steady-state fuel values in the map are likely not to be the proper fuel quantity anytime a transition in engine state or desired engine state occurs. The engine must, however, continue to operate, preferably smoothly, even though the mapped fuel quantity may not be the proper fuel quantity. To compensate for the inaccuracy inherent in selecting fuel quantity based on values existing at the schedule time, additional transient maps are often painstaking created to allow for operation when fuel should be greater than or less than the quantity retrieved from the map. In addition, other techniques may be employed to compensate for incorrect fueling values retrieved from a map and those techniques may be very complex. Therefore, calibration of an engine utilizing an embodiment of predictive fueling may be much simpler since the values entered into the map will typically be much closer to the actual values existing at the time air intake is completed than in traditional fueling systems and may necessitate fewer compensation techniques and lesser compensation for those techniques still employed. Thus, the values in the map should not need to allow for the degree in variation in actual operating condition and desired operating condition when the engine utilizes predictive fueling.

In addition, in the current state of the art the steady-state fuel quantity is often modified to compensate for engine transition, whereas the amount of engine transition occurring will typically be more accurately determined using predictive fueling. An engine transition may be determined based on the difference between current and previous values utilized to retrieve a steady-state fueling value from a map or the difference between the current and previous steady-state values retrieved from the map. If the values utilized to retrieve the steady-state fueling value from the map are based on a schedule time prior to or at the time when fuel delivery begins, or on fueling values that are based on those schedule time values, the transition determination will not recognize any transition occurring between the schedule time and the execution time or the time when the air intake event occurs. By utilizing an embodiment of predictive fueling, however, a transition occurring between the fuel schedule time and the completion of the air intake event will be considered, thereby providing more accurate information on which to base a transition determination. Where secondary injection is used, the predicted engine state and fueling requirement at the time of the combustion event may be further refined so that the magnitude of the transition may be more accurately determined.

Embodiments of predictive fueling may also be used to reduce vehicle emissions. For example, in vehicles meeting or attempting to meet super low vehicle emission specifications, much of the emission of undesirable elements may occur early after the engine has been started when the catalyst has not yet lighted-off or heated to a temperature that promotes operation of the catalyst and minimizes undesirable emissions. To minimize emissions during that time just after the engine has been started, one strategy is to operate the engine in a lean mode wherein the quantity of fuel provided is less than the quantity of fuel that is provided during normal stoichiometric engine operation. Under such lean operating conditions, however, when the throttle is moved, for example from an idle position to a mid-range position, the engine may stall or a cylinder may misfire. Not only is engine stall undesirable, it also may cause the vehicle to fail its emission test. Moreover, a misfire typically causes unburned fuel to be carried into the exhaust system causing a large amount of undesirable emission that may also cause the engine to fail an emission test. The cause of the engine stalling under such conditions may be related to an increased quantity of air entering the combustion chamber 212 in accordance with the movement of the throttle and a lack of a commensurate increase in fuel provided to the combustion chamber 212.

By employing an embodiment of predictive fueling during lean engine operation, a change in throttle position is more likely to be recognized and the continued effect of a continuing change can be reflected in the fuel quantity provided, so that a proper mix of fuel and air may be provided to the combustion chamber 212, combustion may be achieved, and the engine will accordingly not stall or misfire.

The embodiments of predictive combustion management can be provided for internal combustion engine powered land traversing vehicles, watercraft, and flying vehicles, including, for example, automobiles, trucks, motorcycles, all-terrain vehicles, snowmobiles, boats, personal watercraft, and airplanes, and for power generators and engines of various uses.

While the present invention has been disclosed with reference to certain embodiments, numerous modifications, alterations, and changes to the described embodiments are possible without departing from the scope of the present invention, as defined in the appended claims. Accordingly, it is intended that the present invention not be limited to the described embodiments, but that it have the full scope defined by the language of the following claims, and equivalents thereof.

What is claimed is:

1. A predictive combustion device, comprising:

a data acquisition unit having an input at which is to be incident an input signal received from a first sensor related to a characteristic to be considered in a combustion event, the data acquisition unit receiving two values at the input of the data acquisition unit and utilizing those two values and a comparative time of receipt of the two values to determine a rate of change of the input signal, an output at which is to be incident an output signal related to a physical component of the combustion event, and a processor containing instructions which, when executed by the processor, cause the processor to:

predict a state of the characteristic to be considered in the combustion event for a time in the future not equivalent to a whole multiple of the time between the receipt of the two values, based on the rate of change of the input signal; and provide the output signal at the output related to the physical component of the combustion event based on the predicted state of the characteristic.

2. The predictive combustion device of claim 1, wherein the characteristic to be considered in the combustion event is engine load.

3. The predictive combustion device of claim 2, wherein engine load is indicated by engine speed.

4. The predictive combustion device of claim 1, wherein the characteristic to be considered in the combustion event is desired engine load.

5. The predictive combustion device of claim 1, wherein the characteristic to be considered in the combustion event is throttle position.

6. The predictive combustion device of claim 1, wherein the physical component is fuel.

7. The predictive combustion device of claim 1, wherein the physical component is air.

8. The predictive combustion device of claim 1, wherein the physical component is ignition.

9. The predictive combustion device of claim 1, further comprising receiving at least two values from the first sensor at the input of the data acquisition unit and utilizing those at least two values and comparative time of receipt of the at least two values to determine a rate of change of the value received from the first sensor.

10. The predictive combustion device of claim 1, wherein the comparative time of receipt of the two values is elapsed time between receipt of the two values.

11. The predictive combustion device of claim 1, wherein the two values are of equal magnitude.

12. The apparatus of claim 1, wherein the future state is predicted using a first derivative of the characteristic to be considered in the combustion event.

13. The predictive combustion device of claim 1, wherein a plurality of values are received at the input of the data acquisition unit and the future state is predicted using the rate of change of velocity with respect to time.

14. The predictive combustion device of claim 1, wherein the processor further predicts the future state of the characteristic to be considered in the combustion event at least twice prior to the combustion event.

15. The predictive combustion device of claim 14, wherein the processor further provides the physical component at least twice prior to the combustion event.

16. The predictive combustion device of claim 15, wherein a portion of the predicted total physical component requirement is provided each of the at least two times the physical component is provided.

17. An engine, comprising:

at least one cylinder;

a data acquisition unit having an input at which is to be incident a signal received from a first sensor related to a characteristic to be considered in a combustion event for the cylinder, an output at which is to be incident a signal related to a physical component of the combustion event, and a processor containing instructions which, when executed by the processor, cause the processor to:

receive two values at the input of the data acquisition unit and utilize those two values and a comparative time of receipt of the two values to determine a rate of change of the value;

predict a state of the characteristic to be considered in the combustion event for a time in the future not equivalent to a whole multiple of the time between the receipt of the two values, based on the rate of change of the two values related to the characteristic to be considered in the combustion event received at the input of the data acquisition unit; and provide the signal at the output related to the physical component of the combustion event based on the predicted state of the characteristic.

18. The engine of claim 17, wherein the quantity of the physical component delivered to the cylinder is based on the predicted characteristic.

19. The engine of claim 17, wherein the timing of the delivery of the physical component to the cylinder is based on the predicted characteristic.

20. The engine of claim 17, wherein the combustion event is the next combustion event to occur in the cylinder.

21. A vehicle, comprising:

a chassis;

an engine attached to the chassis and having at least one cylinder;

a data acquisition unit having an input at which is to be incident a signal received from a first sensor related to a characteristic to be considered in a combustion event for the cylinder, an output at which is to be incident a signal related to a physical component of the combustion event, and a processor containing instructions which, when executed by the processor, cause the processor to:

receive two values at the input of the data acquisition unit and utilize those two values and a comparative time of receipt of the two values to determine a rate of change of the value;

predict a future state of the characteristic to be considered in the combustion event for a time in the future not equivalent to a whole multiple of the time between the receipt of the two values, based on the rate of change of the two values related to the characteristic to be considered in the combustion event received at the input of the data acquisition unit; and provide the signal at the output related to the physical component of the combustion event based on the predicted state of the characteristic.

22. A method of predicting a quantity of a physical component of a combustion event, comprising:

receiving at least two values related to a characteristic to be considered in a combustion event from a sensor;

predicting a value of the characteristic based on a rate of change determined from the at least two received values and the comparative time of receipt of the two values, for a time in the future not equivalent to a whole multiple of the time between the receipt of the two values; and determining a quantity of a physical component of the combustion event based on the predicted future value of the characteristic.

23. The method of claim 22, wherein the method is performed by an engine control computer.

24. The method of claim 23, wherein the at least two values are received from a sensor.

25. The method of claim 22, further comprising providing the determined quantity of the physical component of the combustion event to an engine.

* * * * *